US006431428B1

(12) United States Patent
Chen

(10) Patent No.: US 6,431,428 B1
(45) Date of Patent: Aug. 13, 2002

(54) PNEUMATIC NAIL GUN

(76) Inventor: Jui-Chin Chen, No. 5, Lane 29, Szewei St., Jen Hwa Li, Ta Li City, Taichung Hsien (TW)

( * ) Notice: Subject to any disclaimer, the term of this patent is extended or adjusted under 35 U.S.C. 154(b) by 89 days.

(21) Appl. No.: 09/688,669

(22) Filed: Oct. 16, 2000

(51) Int. Cl.[7] ..... B25C 4/00

(52) U.S. Cl. ..... 227/120; 227/130; 227/119; 227/148

(58) Field of Search ..... 227/120, 136, 227/130, 140, 148, 137, 119

(56) References Cited

U.S. PATENT DOCUMENTS 4,326,661 A * 4/1982 Maurer et al. ..... 206/338
4,585,154 A * 4/1986 Fealey et al. ..... 227/109
4,778,094 A * 10/1988 Fishback ..... 227/120
5,322,189 A * 6/1994 Oda ..... 221/227
5,579,975 A * 12/1996 Moorman ..... 227/119
5,626,274 A * 5/1997 Shkolnikov et al. ..... 227/109
5,634,582 A * 6/1997 Morrison et al. ..... 206/338
5,683,024 A * 11/1997 Eminger et al. ..... 227/113
5,803,338 A * 9/1998 Singer et al. ..... 227/110

* cited by examiner

*Primary Examiner*—Scott A. Smith
*Assistant Examiner*—Nathaniel Chukwurah
(74) *Attorney, Agent, or Firm*—Renner, Otto, Boisselle & Sklar, LLP

(57) ABSTRACT

A pneumatic nail gun has a body, a handle extending from one end of the body, a barrel mounted on the other end of the body, a magazine pivotally connected to the barrel and assembly for positioning the magazine arranged in the body. With such a pneumatic nail gun, the magazine can be rotated and positioned to a desired angle relative to the barrel. Consequently, the pneumatic nail gun can accommodate different types of nails without changing to a different magazine.

16 Claims, 6 Drawing Sheets

PNEUMATIC NAIL GUN

BACKGROUND OF THE INVENTION

1. Field of the Invention

The present invention relates to a pneumatic nail gun, and more particularly to a pneumatic nail gun with an adjustable magazine to accommodate different types of nails.

2. Description of Related Art

A pneumatic nail gun is always used to shoot a nail to join two objects together. To keep the head of the nail being shot from jamming on the head of the adjacent nail, the magazines are generally constructed so that the nails are loaded into and held in the magazine at a desired angle like 22°, 28° and 34°. The magazine must be securely mounted on the pneumatic nail gun to hold and feed the nails. However, the conventional magazine cannot be adjusted relative to the pneumatic nail gun. A new magazine must be loaded and attached when the user wants to use another type of nail. Consequently, the operation of the conventional pneumatic nail gun involving different types of nail is troublesome. The cost associated with purchasing, storing and maintaining different types of magazines is an economic burden on the user.

To overcome the shortcomings, the present invention intends to provide a pneumatic nail gun with an adjustable magazine to mitigate or obviate the aforementioned problems.

SUMMARY OF THE INVENTION

The main objective of the invention is to provide a pneumatic nail gun with an adjustable. magazine to accommodate different types of nails. The pneumatic nail gun has a body, a handle extending from one end of the body, a barrel mounted on the other end of the body, a magazine pivotally connected to the barrel and means for positioning the magazine located in the body. The magazine can be rotated to a desired angle relative to the barrel of the pneumatic nail gun. Consequently, the pneumatic nail gun can accommodate different types of nails without having to use different magazines.

A further objective of the invention is to provide a pneumatic nail gun with two guides slidably mounted in the barrel. Each guide has at least one spring so that it will abut the other guide. By such an arrangement, the guides will clamp the following nail, the chain connecting the nails or the gap defined between adjacent nails. A good positioning effect can be provided to the following nails.

Other objects, advantages and novel features of the invention will become more apparent from the following detailed description when taken in conjunction with the accompanying drawings.

DETAILED DESCRIPTION OF PREFERRED EMBODIMENT

Figure 1:
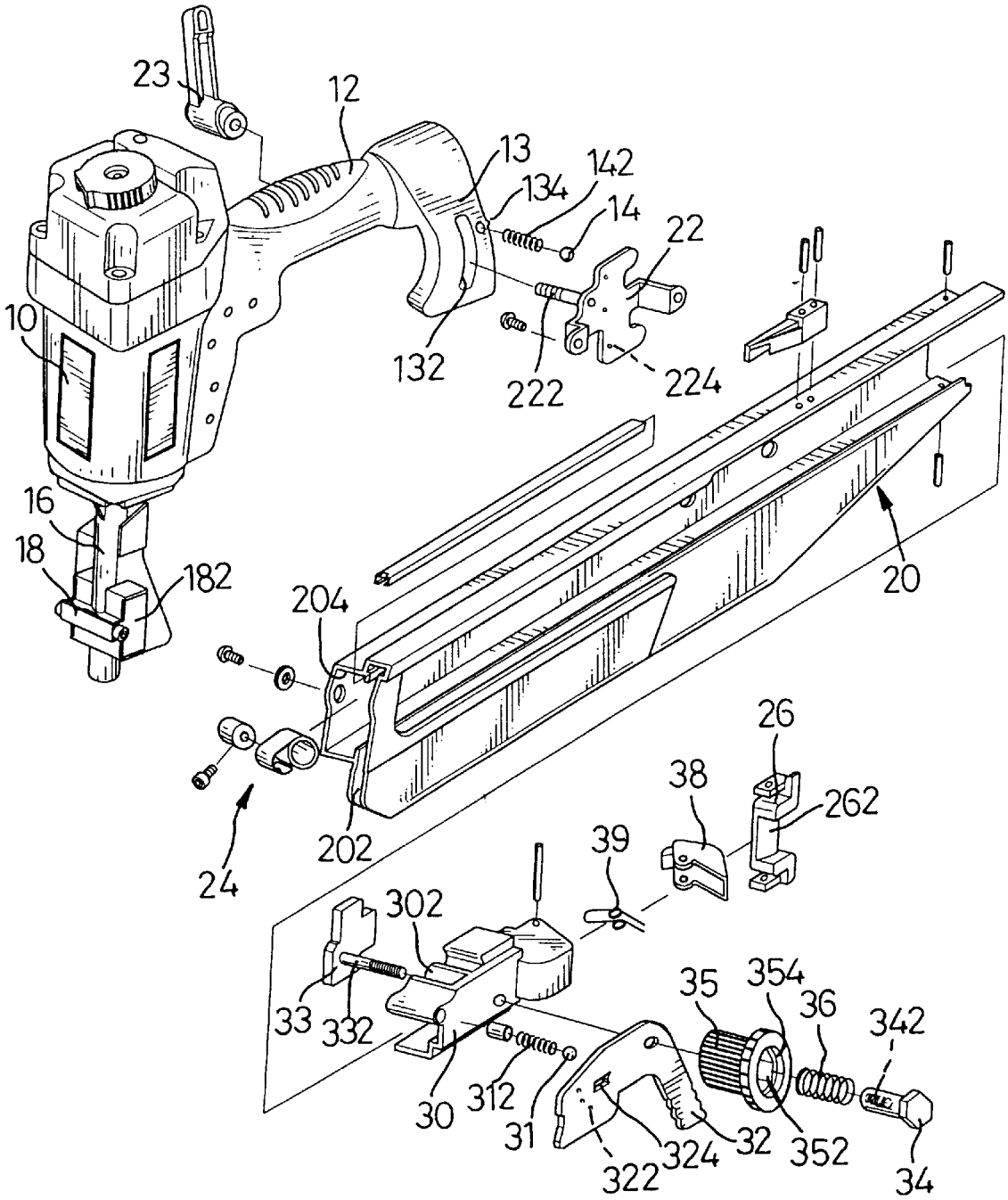
FIG. 1 is an exploded perspective view of a pneumatic nail gun in accordance with the present invention.
Figure 2:
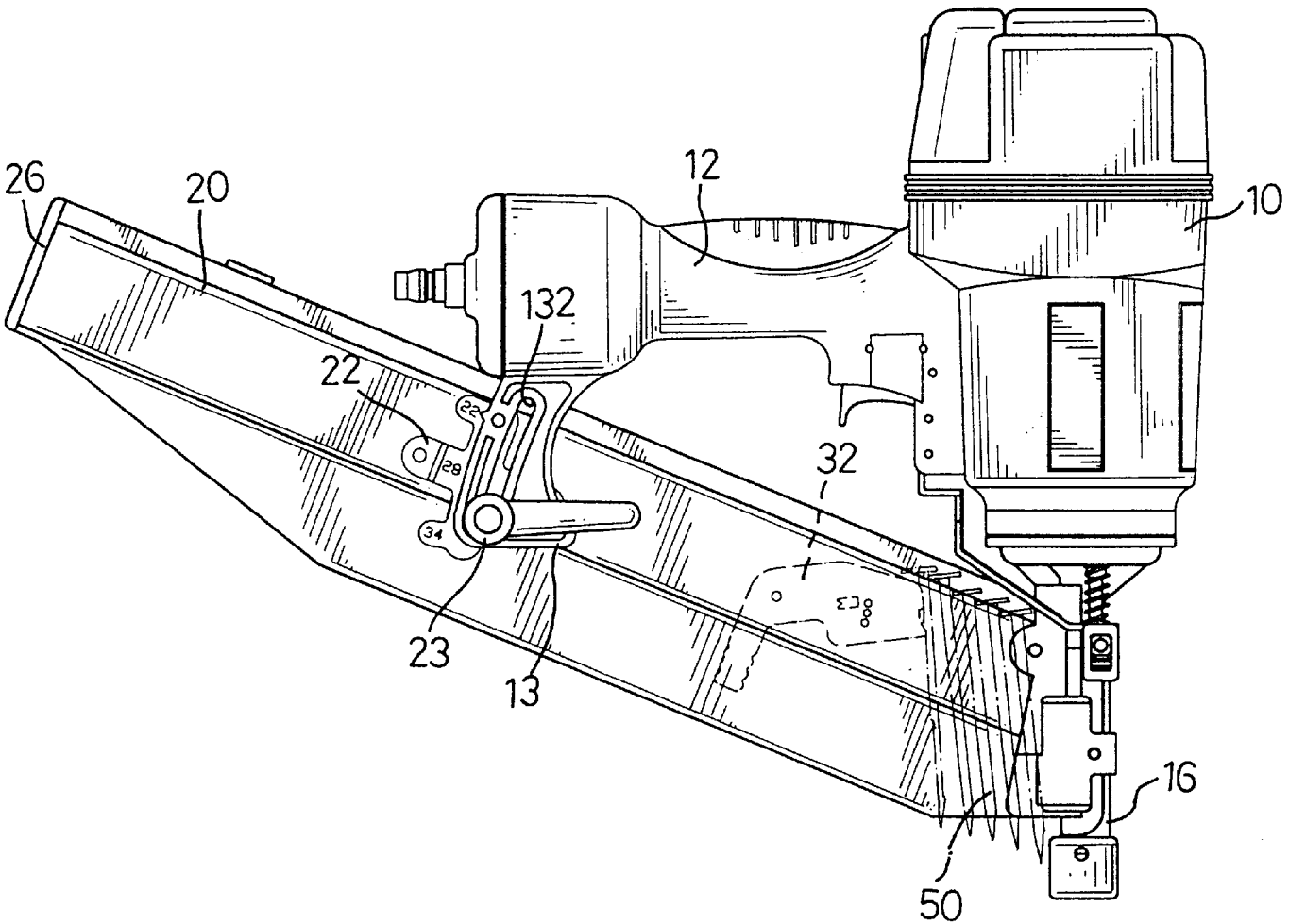
FIG. 2 is a side plan view of the pneumatic nail gun in FIG. 1 with the magazine positioned at an angle relative to the pneumatic nail gun.

With reference to FIGS. 1 and 2, a pneumatic nail gun in accordance with the present invention comprises a hollow body (10) and a magazine (20) pivotally mounted on the body (10). A compressed air mechanism (not shown) is mounted in the body (10) to shoot a nail. A handle (12) integrally extends from one end of the body (10). A tubular barrel (16) is secured to the other end of the body (10).

The magazine (20) is pivotally connected to the barrel (16) with a pivot (Ref. No.?). A channel (202) is defined in the magazine (20) to receive the nails (50) and communicate with the barrel (16), such that the nails (50) can be pushed into the barrel (16) through the channel (202) of the magazine (20) one after another.

An extension (13) integrally extends from the free end of the handle (12). A curved groove (132) is defined through the extension (13). A bore (not numbered) is defined in the extension (13) near the groove (132). A spring (142) is inserted into the bore and biases a ball (14) extending outward from the bore.

A mounting bracket (22) is attached to the magazine (20). A bolt (222) extends from the mounting bracket (22) and through the groove (132) in the extension (13). A knob (23) is screwed onto the bolt (222) to securely hold the magazine (20) on the extension (13) at a desired angle. Multiple depressions (224) are defined in the mounting bracket (22) in an arcuate arrangement corresponding to the curved groove (132) can engage the biased ball (14) in the extension (13) engages one of the depressions (224) to provide a predetermined angular reference for the magazine (20). Consequently, the magazine (20) can be securely attached to the body (10) at a desired angle. The magazine (20) can adapt to receive and hold a desired type of nail (50).

Figure 3:
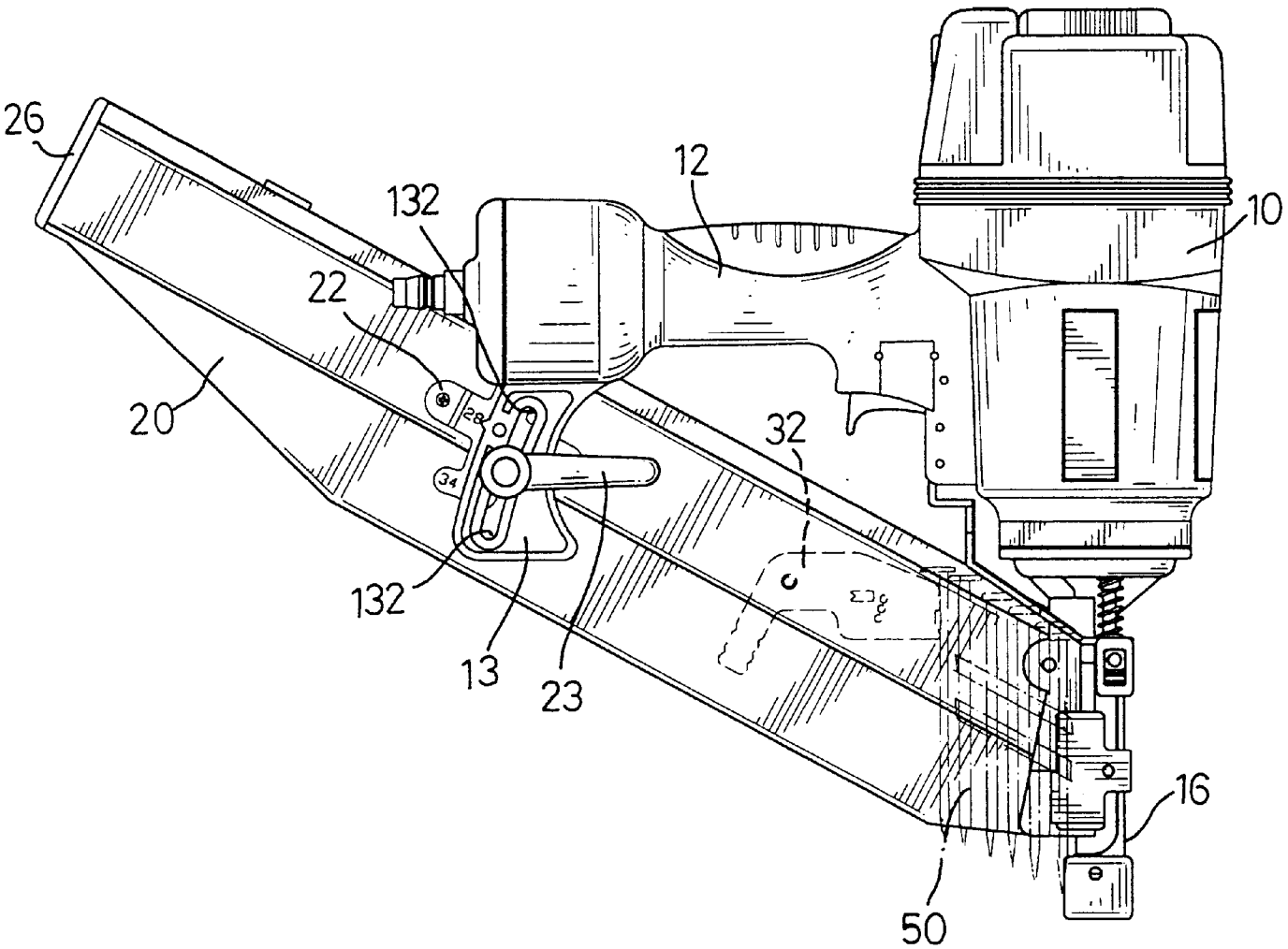
FIG. 3 is an operational side plan view of the pneumatic nail gun FIG. 1 with the magazine positioned at another angle relative to the pneumatic nail gun.

With reference to FIGS. 2 and 3, when the knob (23) is loosened, the magazine (20) with the mounting bracket (22) can rotate relative to the body (10), and the bolt (222) slides along the groove (132). When the ball (14) aligns with and engages another one of the depressions (224), the knob (23) is tightened to lock the angular position of the magazine again. The magazine (20) can be attached to the body (10) at another angle, such that the magazine (20) can be used to hold and feed another type of nail (50).

In addition, multiple angle labels are formed on the mounting bracket (22). A point (134) is formed on the extension (13) to point at the corresponding angle label on the mounting bracket (22). By such an arrangement, the user can read the angle of the magazine (20).

Figure 4:
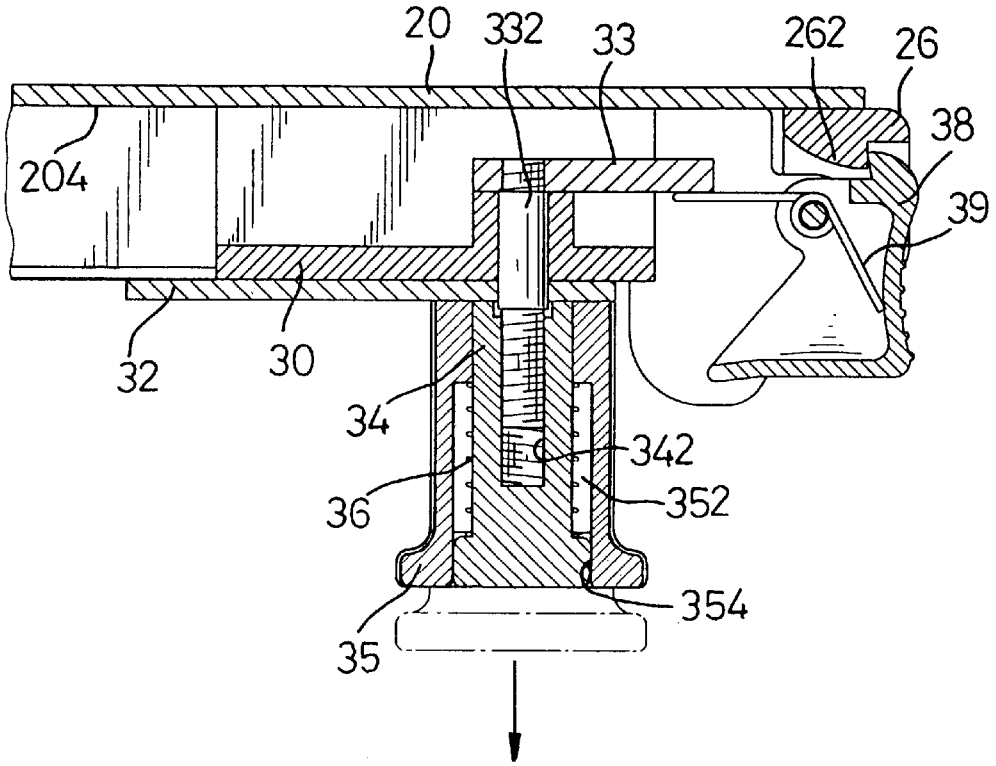
FIG. 4 is a cross sectional top plan view of the sliding base and sleeve in the pneumatic nail gun in FIG. 1.
Figure 5:
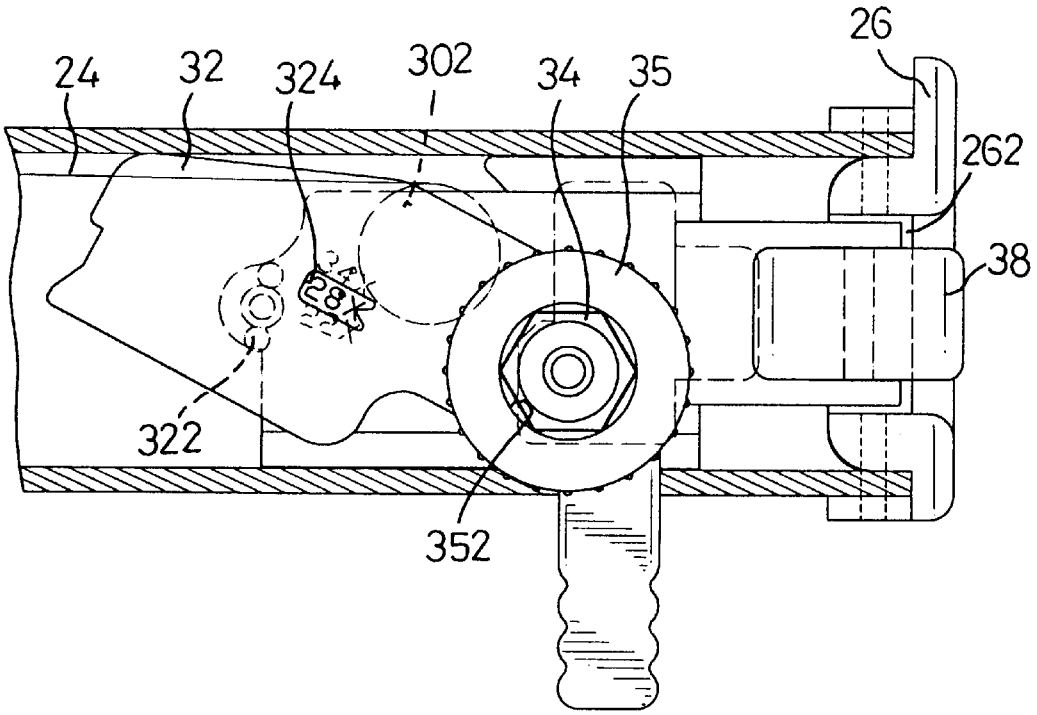
FIG. 5 is a side plan view in partial section of the pusher plate in the pneumatic nail gun in FIG. 1.

With reference to FIGS. 1, 4 and 5, a recess (204) is defined in the magazine (20) and communicates with the channel (202). A sliding base (30) is slidably mounted in the recess (204). A post (302) extends laterally from the base (30). A spiral spring (24) is mounted on the post (302) and has a free end secured to the magazine (20). Accordingly, the sliding base (30) can slide along the recess (204) by the pulling force of the spiral spring (24). A pusher plate (32) is rotatably mounted on the sliding base (30) and received in the channel (202). The pusher plate (32) moves along the channel (202) together with the sliding base (30) to push the nails (50).

In practice, a plate (33) is mounted on the side of the sliding base (30) opposite to the pusher plate (32). A bolt (332) extends from the plate (33) through the sliding base (30) and the pusher plate (32). A nut (34) composed of a non-circular head and a tube with an inner thread (342) is screwed with the bolt (332), such that the pusher plate (32) is attached to the sliding base (30).

A bore (not numbered) is defined in the sliding base (30) and faces the pusher plate (32). A spring (312) is inserted into the bore and biases a ball (31) extending out from the bore. Multiple depressions (322) are defined in the pusher plate (32) in an arcuate arrangement. the ball (31) engages one of the depressions (322) to hold the pusher plate (32) in position. Consequently, the pusher plate (32) can be adjusted to a desired angle relative to the sliding base (30) (as shown in FIG. 2). The pusher plate (32) can be adapted to push a desired type of nail (50).

When the nut (34) is loosened, the pusher plate (32) can rotate relative to the sliding base (30). When the ball (31) aligns with and engages another one of the depressions (322), the nut (34) is tightened again to lock the pusher plate (32) in position. The pusher plate (32) can be fixed relative to the sliding base (30) at another angle, such that the pusher plate (32) can adapt to push another type of nail (50) (as shown in FIG. 3).

In addition, multiple angle labels are formed on the sliding base (30). A window (324) is defined in the pusher plate (32) to align with the corresponding angle label on the sliding base (30). By such an arrangement, the user can see what the indicated angle of the pusher plate (32).

With reference to FIGS. 2 and 3, the magazine (20) can be rotated to a desired angle relative to the barrel (16) of the pneumatic nail gun, such that the magazine (20) can hold a desired type of nail (50). The pusher plate (32) can be rotated to push the desired type of nail (50). Consequently, the pneumatic nail gun can accommodate different types of nails (50) without changing to a different magazine (20).

With reference to FIGS. 1, 4 and 5, a sleeve (35) is co-axially mounted with the nut (34) and has a central hole to receive the nut (34). The central hole of the sleeve (35) has a non-circular portion (352) with a shape the same as the head of the nut (34) and a circular portion (354) with a diameter larger than that of the head of the nut (34). A spring (36) is inserted into the central hole in the sleeve (35) and abuts the head of the nut (34), such that the head of nut (34) is received in the circular portion (354) of central hole of the sleeve (35). When the user pulls the sleeve (35), the head of the nut (34) will insert into and engage with the non-circular portion (352) of the central hole of the sleeve (35). Consequently, the user can release or lock the nut (34) by turning the sleeve (35). The operation of the nut (34) is simplified.

A latch (38) is pivotally mounted on one end of the sliding base (30). A spring (39) co-axially mounted on the latch (38) has two ends respectively abutting the sliding base (30) and the latch (38). A stopper (26) is pressed into the end of the magazine (20) opposite from the barrel (16). A protrusion (262) is integrally formed on the stopper (26). When the sliding base (30) is pulled to the end of the magazine (20) with the stopper (26), the latch (38) will engage with the protrusion (262) of the stopper (26). The sliding base (30) will not return even with the force of the spiral spring (24) pulling on the base (30). The magazine (20) can be replenished by inserting new nails (50) into the channel (202). The user releases the latch (38) from the stopper (26) by pushing the latch (38). The sliding base (30) with the pusher plate (32) will return by means of the force provided by the spiral spring (24). The pusher plate (32) then abuts the nails (50) to push the nails (50) to the barrel (16).

Figure 6:
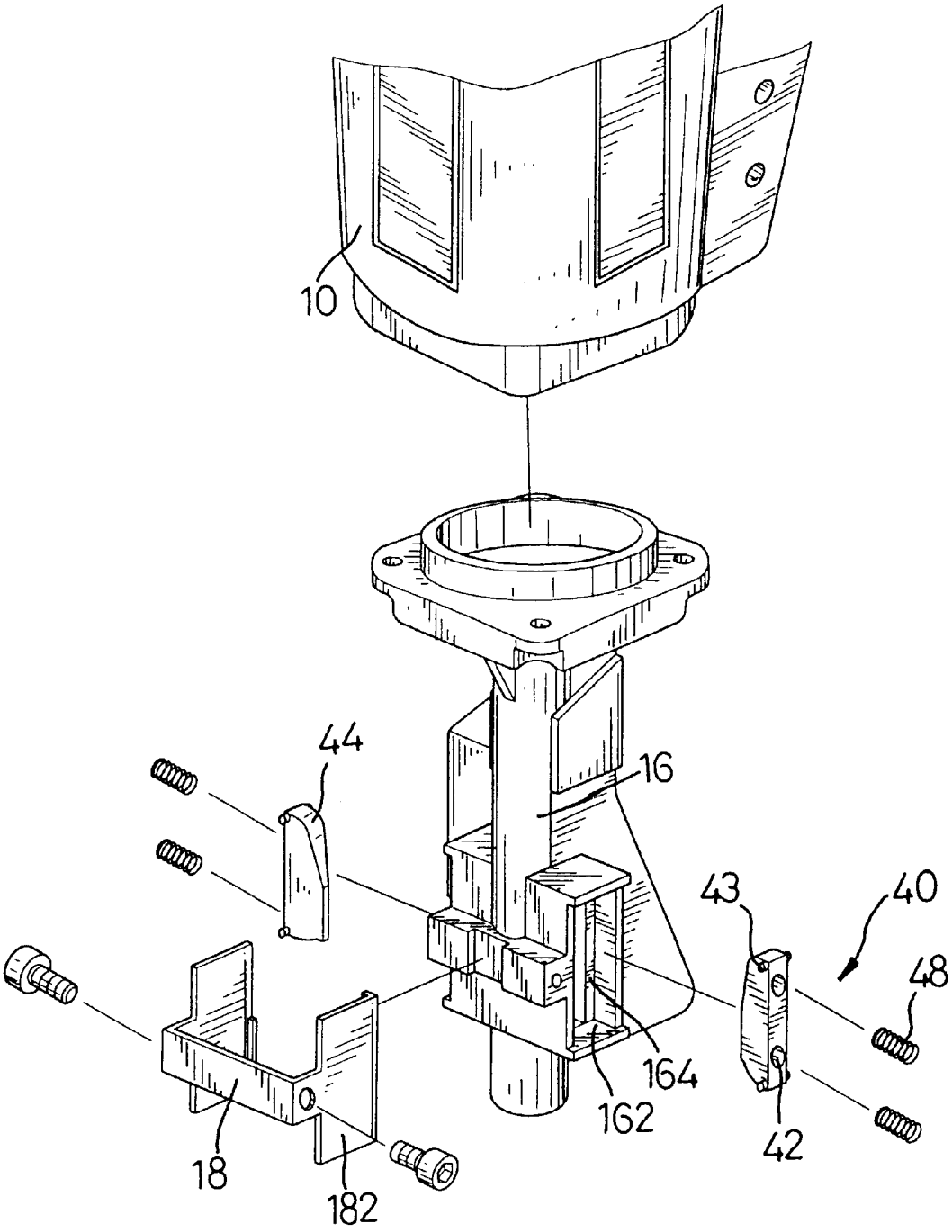
FIG. 6 is an exploded perspective view of the barrel of the pneumatic nail gun in FIG. 1.
Figure 7:
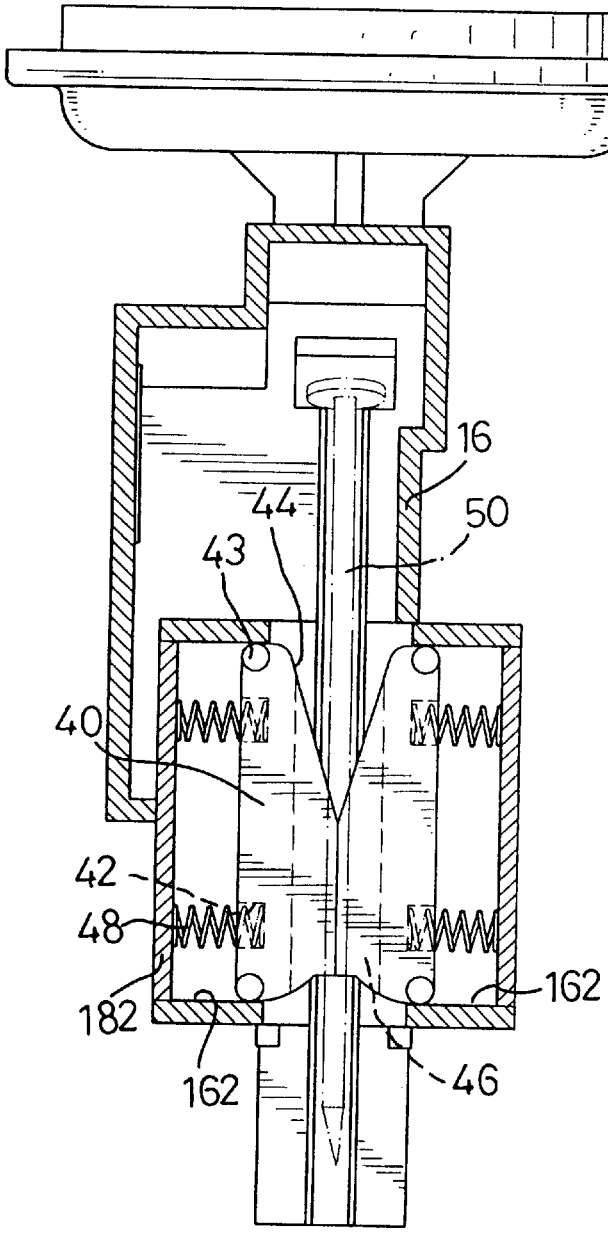
FIG. 7 is a front plan view in partial section of the barrel of the pneumatic nail gun in FIG. 6.
Figure 8:
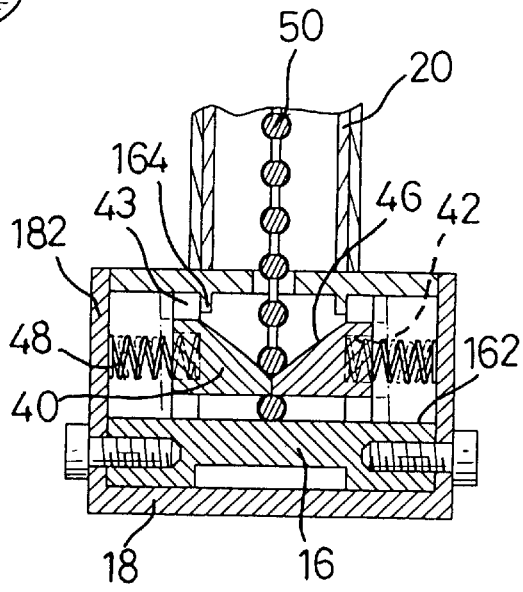
FIG. 8 is a cross sectional top plan view of the barrel of the pneumatic nail gun in FIG. 6.

With reference to FIGS. 6 to 8, two chambers (162) are defined on the opposite side of the barrel (16). A cover (18) is mounted on the barrel (16) and has two sides (182) each covering one of the chambers (162). A guide (40) is slidably received in each chamber (162). At least one spring (48) is mounted between each guide (40) and the corresponding side (182) of the cover (18) to push the guide (40) into the barrel (16) and abut to each other. A recess (42) is defined in the side of the guide (40) away from the other guide (40) to receive the end of one of the springs (48). A flange (164) is formed on one of the inner sides of each chamber (162). At least one stub (43) extends from one of side of each guide (40) to abut the flange (164) in the chamber (162). This can keep the guide (40) in each chamber (162) and keep the guide (40) from entirely extending into the barrel (16).

By such an arrangement, when the topmost nail (50) is pushed into the barrel (16), the nail (50) will push the guides (40) away from each other, such that a gap is defined between the two guides (40) to allow the nail (50) to pass through the gap. When the topmost nail (50) passes through the gap, the guides (40) will abut each other by the pushing force of the springs (48). Accordingly, the two guides (48) will clamp the following nail (50), the chain connecting the nails (50) or the gap defined between adjacent nails (50). Consequently, a good positioning effect can be provided to the following nail (50). This ensures that the topmost nail (50) is completely separated from the following nail (50) as the topmost nail (50) is shot by the compressed air mechanism in the body (10).

In addition, a bottom oblique face (46) is defined in each guide (40) on the side facing the magazine (20). A rear oblique face (44) is defined in each guide (40) on the side facing the body (10) of the pneumatic nail gun. The bottom oblique face (46) provides a guiding effect to the nail (50) to separate the guides (40). The rear oblique face (44) provides a guiding and modification effect to the topmost nail (50) when it is shot. The travel of the nail (50) will be smoother.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic nail gun comprising:

a body having a compressed air mechanism mounted in the body;

a handle extending from one end of the body;

a barrel mounted on the other end of the body;

a magazine pivotally connected to the barrel and having a channel defined in the magazine and communicating with the barrel to be adapted to receive the nails; and means for positioning the magazine arranged in the body, whereby the angle of the magazine relative to the barrel is selectively adjustable.

2. The pneumatic nail gun as claimed in claim 1, wherein means for positioning the magazine comprises:

an extension integrally extending from the handle;

a curved groove defined through the extension a mounting bracket secured on the magazine a bolt extending from the mounting bracket and through the groove; and a knob screwed onto the bolt to securely mount the magazine on the extension.

3. The pneumatic nail gun as claimed in claim 2, wherein a bore is defined in the extension and near the groove;

a spring is received in the bore and biases a ball extending outward from the bore; and multiple depressions are defined in the mounting bracket in an arcuate arrangement the same as the curved groove;

thereby, the ball can engage one of the depressions to provide a predetermined position reference for the magazine.

4. The pneumatic nail gun as claimed in claim 3, wherein multiple angle labels are formed on the mounting bracket; and a point is formed on the extension to point at one of the angle label on the mounting bracket.

5. The pneumatic nail gun as claimed in claim 1, wherein a recess is defined in the magazine and communicates with the channel;

a sliding base is slidably received in the recess;

a post extends laterally from the base;

a spiral spring is mounted on the post and has a free end secured to the magazine; and a pusher plate is rotatably mounted on the sliding base and received in the channel to be adjusted to push the nails in the magazine.

6. The pneumatic nail gun as claimed in claim 5, wherein a plate is arranged beside the sliding base on the opposite side from the pusher plate;

a bolt extends from the plate and through the sliding base and the pusher plate; and a nut is screwed onto the bolt and is composed of a non-circular head and a tube with an inner thread to attach the pusher plate to the sliding base.

7. The pneumatic nail gun as claimed in claim 6, wherein a bore is defined in the sliding base and faces the pusher plate;

a spring is received in the bore and biases a ball extending outward from the bore; and multiple depressions are defined in the pusher plate in an arcuate arrangement;

thereby, the ball can engage one of the depressions to provide a predetermined position reference for the pusher plate.

8. The pneumatic nail gun as claimed in claim 7, wherein multiple angle labels are formed on the sliding base; and a window is defined in the pusher plate to align with the appropriate angle label on the sliding base.

9. The pneumatic nail gun as claimed in claim 6, wherein a sleeve is co-axially mounted on the sliding base with the nut;

a central hole is defined in the sleeve to receive the nut, and has a non-circular portion with a shape the same as the head of the nut and a circular portion with a diameter larger than that of the head of the nut; and a spring received in the central hole of the sleeve to abut the head of the nut.

10. The pneumatic nail gun as claimed in claim 5, wherein a latch is pivotally mounted on one end of the sliding base;

a spring is co-axially mounted on the latch, and has two ends respectively abutting the sliding base and the latch;

a stopper is pressed into the magazine at the end away from the barrel; and a protrusion is integrally formed on the stopper to engage with the latch when the sliding base is pulled to the end of the magazine with the stopper.

11. The pneumatic nail gun as claimed in claim 1, wherein two chambers are respectively defined on the opposite sides of the barrel;

a cover is mounted on the barrel and has two sides each covering one of the chambers;

a guide slidably received in each chamber; and at least one spring mounted between each guide and the corresponding side of the cover so as to push the guide to extend into the barrel and abut the other guide.

12. The pneumatic nail gun as claimed in claim 11, wherein a recess is defined in the guide on the side away from the other guide to receive one end of each spring.

13. The pneumatic nail gun as claimed in claim 11, wherein a flange is formed on one of the inner sides of each chamber; and at least one stub extending from one side of each guide to abut the flange in the chamber.

14. The pneumatic nail gun as claimed in claim 11, wherein a bottom oblique face is defined in each guide on the side facing the magazine.

15. The pneumatic nail gun as claimed in claim 14, wherein a rear oblique face is defined in each guide on the side facing the body.

16. The pneumatic nail gun as claimed in claim 11, wherein a rear oblique face is defined in each guide on the side facing the body.

* * * * *